US005652943A

United States Patent [19]

Matsuo

[11] Patent Number: 5,652,943

[45] Date of Patent: Jul. 29, 1997

[54] IMAGE FORMING APPARATUS HAVING A PLURALITY OF SENSORS FOR DETECTING WHETHER THE FED SHEET IS AN OHP OR PLAIN PAPER SHEET

[75] Inventor: Toshihisa Matsuo, Nara, Japan

[73] Assignee: Sharp Kabushiki Kaisha, Osaka, Japan

[21] Appl. No.: 662,509

[22] Filed: Jun. 13, 1996

[30] Foreign Application Priority Data

Jul. 20, 1995 [JP] Japan ..... 7-183974

[51] Int. Cl.[6] ..... G03G 21/00

[52] U.S. Cl. ..... 399/21; 399/45; 399/389

[58] Field of Search ..... 399/21, 45, 389

[56] References Cited

U.S. PATENT DOCUMENTS

| | | | |
|---|---|---|---|
| 5,138,392 | 8/1992 | Kinoshita et al. | 355/289 |
| 5,282,001 | 1/1994 | Watson | 355/208 |

FOREIGN PATENT DOCUMENTS

| | | |
|---|---|---|
| 60-216359 | 10/1985 | Japan . |
| 61-101356 | 5/1986 | Japan . |
| 64-82049 | 3/1989 | Japan . |

*Primary Examiner*—Nestor R. Ramirez

[57] ABSTRACT

An image forming apparatus of the invention includes: a sheet-type determining device which determines whether the fed sheet is of plain paper or of OHP film; a first timer which sets up the arrival timing of the sheet for the high-speed mode; a second timer which sets up the arrival timing of the sheet for the low-speed mode; a selecting device which selects the first timer when the type of the sheet determined by the sheet-type determining device is plain paper and selects the second timer in the case of OHP film; and a warning device which, if in either of the modes, the sheet does not reach a predetermined site within the predetermined arrival time, determines that the sheet has jammed and informs the user of the point of jamming.

4 Claims, 11 Drawing Sheets

IMAGE FORMING APPARATUS HAVING A PLURALITY OF SENSORS FOR DETECTING WHETHER THE FED SHEET IS AN OHP OR PLAIN PAPER SHEET

BACKGROUND OF THE INVENTION (1) Field of the Invention

The present invention relates to an image forming apparatus, particularly relating to the improvement of the sheet conveying system in an image forming apparatus such as a copier, printer, PPC facsimile etc.

(2) Description of the Prior Art

FIG. 1 is a sectional view showing a copier typically used as an image forming apparatus in the field of the industry. In the figure, an original document is placed on a table glass 2 in the upper part of a copier machine body 1. As the copy start button (not shown) is operated, an exposure lamp 3 illuminates the original and the reflected light having the image information is passed through first through sixth mirrors 4 to 9 and a lens 24 to a photoreceptor 10. To scan the entire document, the exposure lamp 3 as well as the first to third mirrors (4 to 6) is driven via unillustrated wire by means of a scanner motor 23. The photoreceptor is electrified by a main charger 11. The illuminated image on the photoreceptor is developed in a developing unit 12. A sheet is fed from a cassette 21 and is delivered out by a feed roller 17. The developed image on the photoreceptor is transferred to the delivered sheet by a transfer charger 13 and the sheet is separated from the photoreceptor by a separating charger 14 and is conveyed by a suction belt 18 to a fixing roller 19 where the transferred image on the sheet is fixed. The finished copy is discharged to a sheet output unit 20. Reference numerals 15 and 16 designates a cleaning unit and an charge-erasing charger, respectively. Here, the photoreceptor 10, the roller in the developing unit 12, the feed roller 17, the suction belt 18, the fixing roller 19 are driven by driving forces which are transmitted through belts, gears etc., from an unillustrated main motor. Reference numerals 52 through S7 in FIG. 1 indicate sheet detecting sensor arranged in the sheet conveyance path and S1 indicates a sheet-detecting sensor arranged so as to detect the emptiness of the cassette 21.

By the way, the sheet feeding portion as well as the sheet conveying portion in the conventional image forming apparatus thus configured has used either of two kinds of sensors, specifically, the contact-type sensor shown in FIGS. 2A and 2B or the reflection-type sensor shown in FIG. 3, as the aforementioned detecting sensors for detecting the sheet. FIG. 2A is a perspective view showing an example of the contact-type sensor, and FIG. 2B is a side view of FIG. 2A. In the figure, 30 designates a contact-type sensor body and 31 designates an actuator as a detecting lever. The actuator 31 is mounted on a pivot 32 and urged by a spring 33 so that the free end of the actuator 31 will press an object (not shown) to be detected. One end of the spring is engaged on a spring stopper surface 35 while the base of the actuator 31 is stopped by an actuator stopper surface 34 so as to prevent an excessive rotation. The rotation of the actuator 31 when the object to be detected is sensed is outputted as an electric signal by one of publicly known electrical or mechanical means, whereby the detected signal is supplied to the control system. FIG. 3 is a perspective view showing an example of the reflection-type sensor. In the figure, 40 designates a reflection-type sensor body and 41 designates a light emitting/receiving section. For the structure of the reflection-type sensor and the output scheme of the signal, any of publicly known methods can be applied appropriately.

On the other hand, Japanese Patent Application Laid-Open Sho 60 No. 216,359 discloses a system in which, by using a pair of sensors, namely a contact-type sheet sensor and a reflection-type sensor disposed in the manual bypass feeding section or the sheet feeding cassette, it is distinguished whether the sheet to be fed is a plain paper sheet or an OHP film sheet based on the detected outputs from the two sensors, and in accordance with the determined result, the processing conditions for image forming (in this disclosure, it is referred that the fixing speed and the generation of the transfer high-voltage current are controlled in accordance with the type of the sheet) are set up.

Further, Japanese Patent Application Laid-Open Sho 64 No. 82,049 discloses a system in which, by using a pair of sensors, namely, a contact-type sheet sensor and a reflection-type sensor disposed along the sheet conveyance path on the upstream of the transfer station, it is distinguished whether the conveyed sheet is a plain paper sheet or an OHP film sheet based on the detected outputs from the two sensors, and in accordance with the determined result, the transfer charger output and the fixing speed are set up in accordance with the type of the sheet.

However, in the above documents which are publicly known, the fed sheet is distinguished at only the feeding port by the contact-type and reflection-type sensors provided therein, and all the sheet detecting sensors do not use both the contact-type and reflection-type sensors.

That is, the conventional systems use any of the contact-type and reflection-type sensors to detect sheets. In this case, the reflection-type sensor can not perform detection of a sheet if the sheet is of OHP film. The contact-type sensor would have detecting failures if sheets are successively fed at shorter intervals since the output signal from the sensor is caused to chatter due to the movement of the lever. For example, as shown in FIG. 4A, if the output signal from the contact-type sensor is chattering, the detection of the sheet during chattering should be ignored. However, if the interval between one sheet and the next becomes shorter, the signal behaves as seen in FIG. 4B, making it impossible to detect the sheets. Here, FIG. 4A is a timing chart representing the chattering of the contact-type sensor when sheets are fed at sufficiently long intervals; and FIG. 4B is a timing chart showing the chattering of the same sensor when sheets are fed at shorter intervals. In theses charts, the vertical axis represents ON/OFF states, and the horizontal axis (t-direction) indicates the timing (of the passage time of the sheet).

Thus, in order to feed plain paper sheets at a high rate (or at closer intervals between one sheet to the next), the reflection-type sensor which is free from chattering will have to be used since the contact-type sensor has a limit to shorten the feeding interval- However, the use of only the reflection-type sensor cannot deal with the detection of OHP sheets. Therefore, there was no method which was able to both feed plain paper sheets at a high rate and perform, by any means, a proper copying operation for the OHP sheet.

Further, in accordance with the above two publicly known techniques, the pair of the sensors (contact-type and reflection-type sensors) provided in the sheet feeding port (portion) is used to distinguish between plain paper sheets and OHP sheets in order to set up the charger output in the transfer station and the fixing speed based on the detected result. However, the two sensors are arranged only at the sheet feeding port (portion), while only one kind of sensor is arranged at any other locations along the sheet conveyance path, respectively.

Anyway, in accordance with any of the conventional methods, as to conveying a plain paper or OHP film sheet (from the feeding port to the output port), there is no technical idea to effectively achieve the sheet conveyance in order to improve the processing performance of the image forming apparatus, by optimizing the sheet conveyance speed.

SUMMARY OF THE INVENTION

It is therefore an object of the present invention to improve the sheet conveying operation in the image forming apparatus and in particular to reduce the operation time of the image forming process by determining the type of the sheet between plain paper and OHP film and improving the efficiency of feeding the sheet for each type.

The present invention has been achieved to attain the above object, and the gist of the invention is as follows:

First, in accordance with the first aspect of the invention, an image forming apparatus includes:

a plurality of sensors disposed along the sheet conveyance path from the sheet feeding portion to the transfer portion, each of the sensors being composed of a contact-type sensor and a reflection-type sensor;

sheet-type determining means which, based on the detected output from the closest sensor to the sheet feeding portion, determines whether the fed sheet is of plain paper or of OHP film;

a first timer which sets up the predetermined arrival timing of the sheet to be conveyed through the sensors in accordance with the size of the sheet for the high-speed mode in which the sheets are fed at shorter intervals;

a second timer which sets up the predetermined arrival timing of the sheet to be conveyed through the sensors in accordance with the size of the sheet for the low-speed mode in which the interval of sheet feeding is controlled as long as possible within a predetermined range;

selecting means which selects the first timer when the type of the sheet determined by the sheet-type determining means is plain paper and selects the second timer in the case of OHP film; and warning means which, if in either of the modes, the sheet does not reach a predetermined site within the predetermined arrival time, determines that the sheet has jammed and informs the user of the point of jamming.

Next, the second aspect of the invention resides in an image forming apparatus having the first feature and further including: conveyance timing-adjusting means which when the sheet is not detected by the reflection-type sensors, monitors the output signals from all the contact-type sensors and adjusts the conveyance timing of the sheet in the low-speed conveying mode in accordance with the augment of the amount of chattering detected from the output signals.

Next, the third aspect of the invention resides in an image forming apparatus having the first feature and further including: conveyance timing-adjusting means which adjusts the conveyance timing of the sheet in the low-speed conveying mode in accordance with the predetermined number of copies and predetermined passage of time.

Further, the fourth aspect of the invention resides in an image forming apparatus having the first feature and further including: warning means which when the sheet is not detected by the reflection-type sensors, monitors the output signals from all the contact-type sensors and informs the location of the only sensor which presents an excessive amount of chattering over a predetermined boundary value.

DESCRIPTION OF THE PREFERRED EMBODIMENTS

The embodiment of the invention will hereinafter be described with reference to the accompanying drawings.

Figure 1:
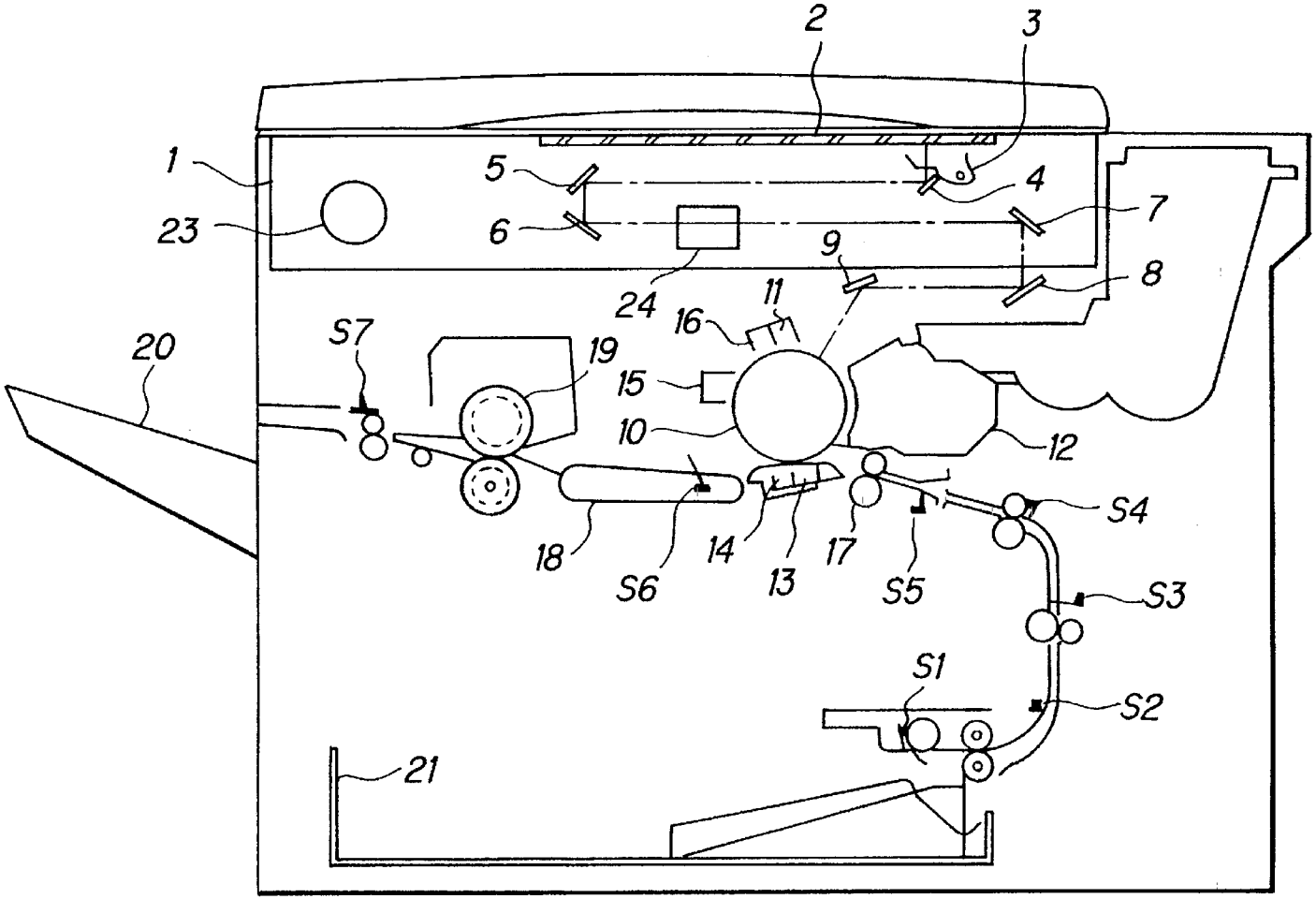
FIG. 1 PRIOR ART
FIG. 1 is a sectional view showing a conventional copier.

First, the image forming apparatus to be targeted of the invention is the same as the typical copier exemplified in FIG. 1, therefore description of the structure of the copier will be omitted.

Figure 5:
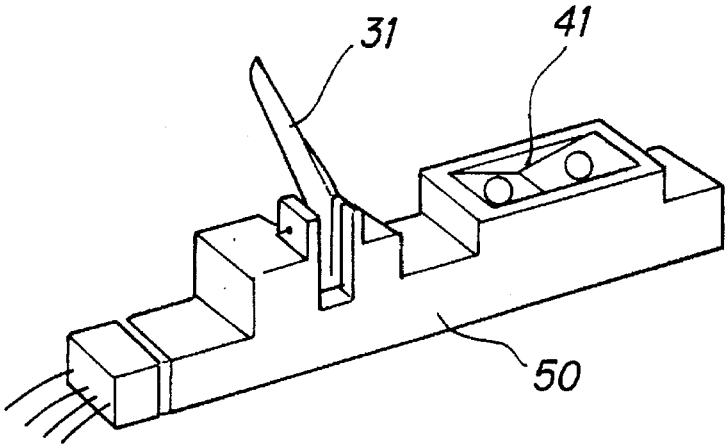
FIG. 5 is perspective view showing a sheet detecting sensor (contact-type sensor plus reflection-type sensor)
Figure 6:
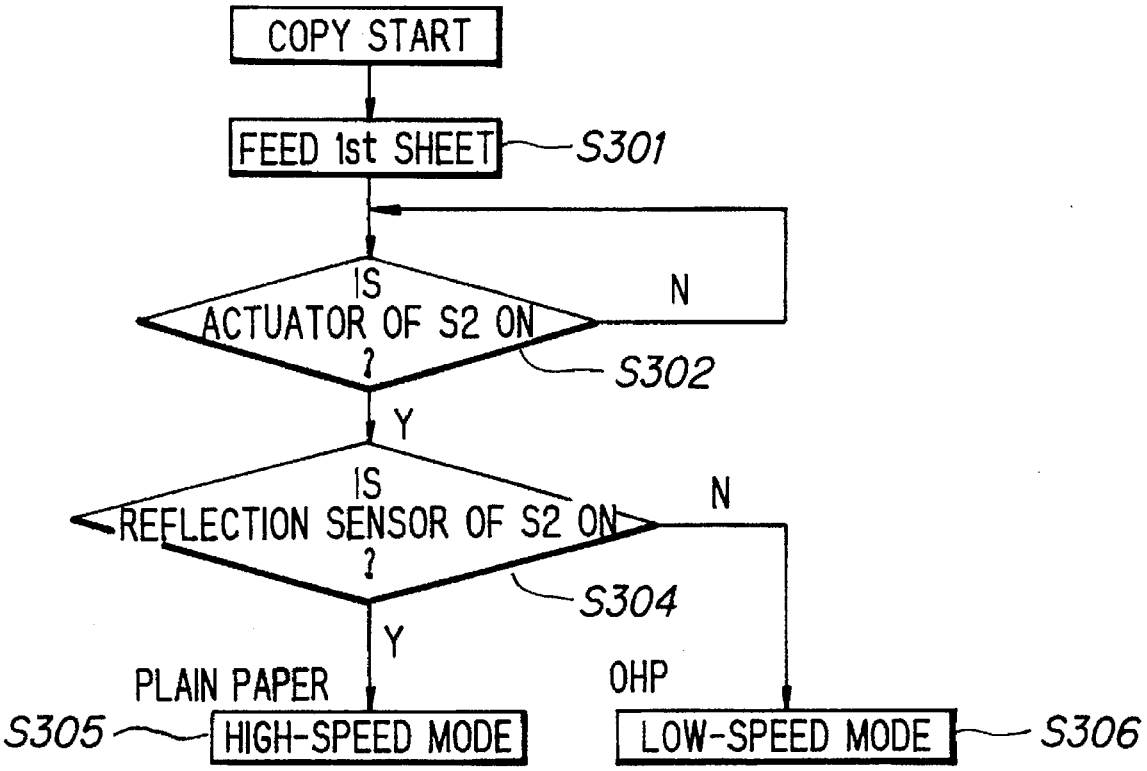
FIG. 6 is a flowchart showing the operation of determining the kinds of a sheet.

Next, the characteristic feature of the invention resides in that a combined sensor which, as perceptively shown in FIG. 5, is formed of a contact-type sensor and a reflection-type sensor is used as the sheet detection sensors S2 to S7 along the conveyance path shown in FIG. 1. Specifically, in FIG. 5, 50 designates a detection sensor body on which a main component part of a contact-type sensor having an actuator 31 and another main component part of a reflection-type sensor having a light emitting/receiving section 41 are integrally provided so as to be able to perform respective functions. Hereinbelow, the action during the copying operation will be described with reference to the flowchart in FIG. 6.

Initially, as the copying operations starts, a sheet is fed from the cassette (S301). This sheet is first detected by the sensor S2 (S302). The outputs from the sensor S2, that is, the output from the contact-type sensor and the output from the reflection-type sensor, are picked up. It is determined whether the sheet is of plain paper or OHP film (if only the contact-type sensor is 'on', the sheet is determined as an OHP film, whereas if both the contact-type and reflection-type sensors are 'on', the sheet is determined as plain paper.) (S304). After the determination of the sheet, the sheet feeding is controlled based on the result of the determination as follows: That is, if the sheet is of plain paper, the interval between one sheet to the next is set into the high-speed mode and as to all the sensors S3 to S7 on the downstream, the outputs from their reflection-type sensors are made valid. When the sheet is of OHP film, the interval of the sheet feeding is set into the low-speed mode and the outputs from their contact-sensors are made valid (S305 and S306).

Figure 7A:
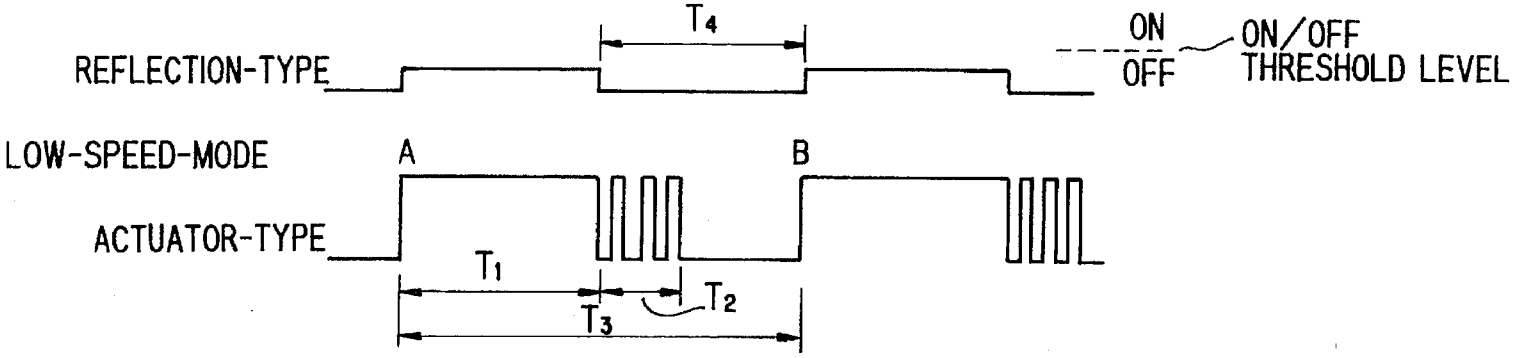
FIG. 7A is a time chart (for the low-speed mode) showing the output signal from the sheet detecting sensor.

Next, the behaviors of the sensor outputs from the detecting sensors will be described. The sensor outputs in the low-speed mode are shown in FIG. 7A. In the low-speed mode where the OHP sheet was detected, the level of the output from the reflection-type sensor will not rise above the ON/OFF threshold level because the OHP sheet is transparent, so that the detection cannot be made. The output from the contact-type sensor chatters during the period of $T_2$, the interval ($T_4$) of feeding sheets are taken long enough (more than $T_2$) to be able to detect the next sheet. That is, after the detection of the sheet at a point A, the output from the contact-type sensor is checked again after the duration of the passing time ($T_1$) of the sheet plus $T_2$. If this output is in 'on-state', it is assumed that the sheet has not passed and has jammed at that point. If this output is in 'off-state', it is assumed that the sheet has passed and the next detection of the sheet is performed at a point B after the duration of $T_3$.

Figure 7B:
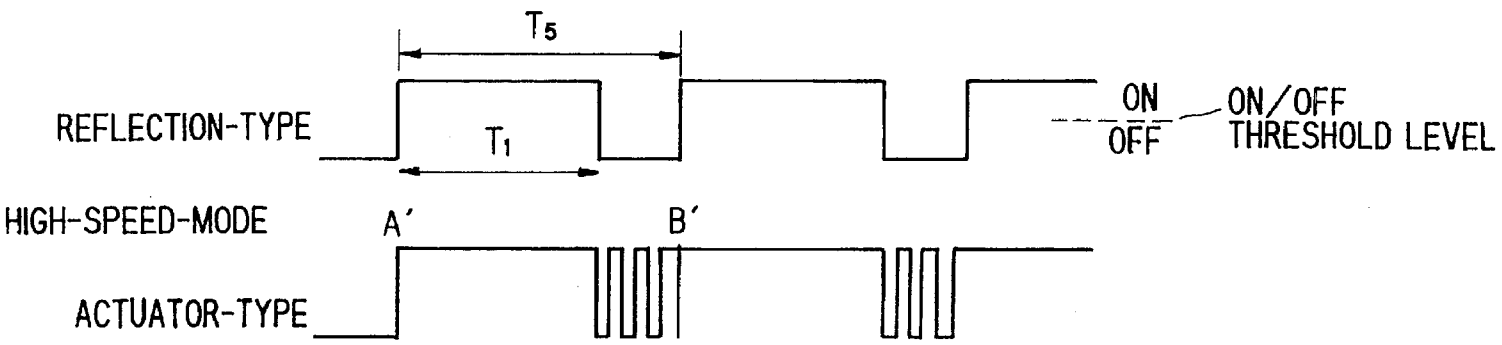
FIG. 7B is a time chart (for the high-speed mode) showing the output signal from the sheet detecting sensor.

The sensor outputs in the high-speed mode are shown in FIG. 7B. In the case of the plain paper sheet, although it is difficult to detect the next sheet at point B' since the output from the contact-type sensor is chattering, the reflection-type sensor can readily detect the next sheet. Let us consider a case where the above detecting method of the next sheet is tried by using the contact-type sensor. As the state of the contact-type sensor is checked again after the duration of $T_1$ plus $T_2$, despite that the next sheet is passing through the detecting point, the sensor cannot detect the fact and will assume that the first sheet remains in the path and has jammed at that point. In contrast, when the reflection-type sensor checks the output of the sensor again after the time T1 from the detection of the sheet, if the sensor output is in off-state, the sheet is assumed to have passed by and the next sheet is detected after the time of $T_5$. If the sensor output thus checked is in 'on-state', the sheet is determined to remain in the path and have jammed at that point. Thus, the mode in which the interval($T_5$–$T_1$) from the one sheet to the next is taken to be less than $T_2$ should be assumed to be the high-speed mode.

Figures 8A, 8B, 8C:
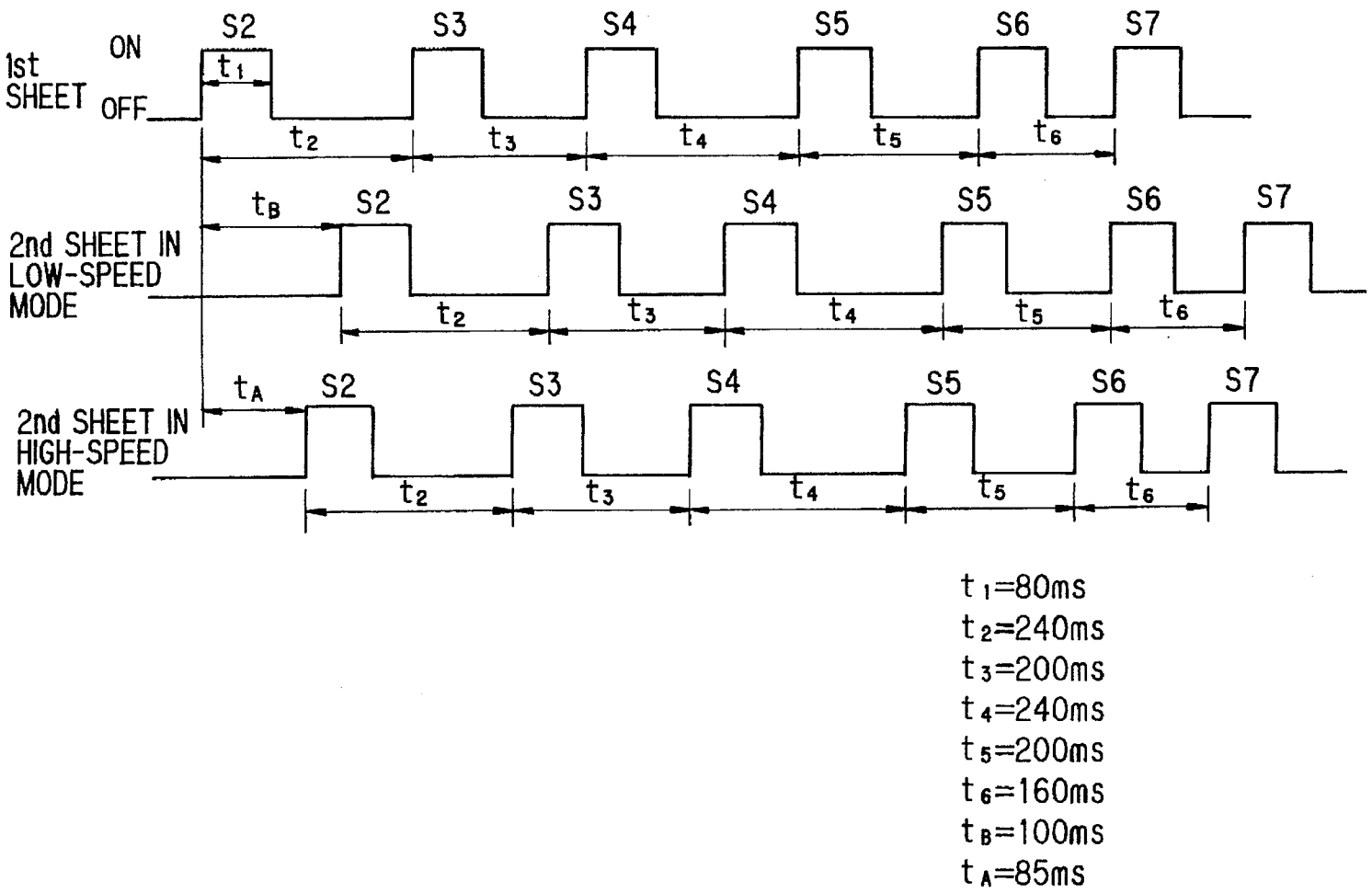
FIG. 8A is a chart showing the timing of the first sheet passing through sheet detecting sensors at different sites.
FIG. 8B is a chart (for the low-speed mode) showing the timing of the second sheet passing through sheet detecting sensors at different sites.
FIG. 8C is a chart (for the high-speed mode) showing the timing of the second sheet passing through sheet detecting sensors at different sites.

Next, description will be made of the first timer (for the high-speed mode) and the second timer (for the low-speed mode) which set up the arrival timing of the sheet to be conveyed through the sensors (S2 to S7) for the high-speed mode and the low-speed mode, respectively (FIGS. 8A, 8B and 8C show examples of $t_1$ through $t_6$ and $t_A$ and $t_B$ simultaneously.).

FIG. 8A shows the time when the first sheet passes through each of the sensors. Of these, $t_1$ is a period of time during which each sensor will be being turned on. This value is common for all the sensors S2 through S7. The time $t_2$ indicates a period from when the sensor S2 is turned on to when the sensor S3 is turned on; $t_3$ indicates a period from when the sensor S3 is turned on to when the sensor S4 is turned on; $t_4$ indicates a period from when the sensor S4 is turned on to when the sensors 5 is turned on; $t_5$ indicates a period from when the sensors 5 is turned on to when the sensor S6 is turned on; and $t_6$ indicates a period from when the sensor S6 is turned on to when the sensor S7 is turned on. That is, if no paper jam occurs, the sensors will normally be turned on in accordance with the time sequence.

When the first sheet is detected at S2, either of the high-speed and the low-speed modes is selected as in the above manner. In the low-speed mode, the second sheet will be delivered so as to activate the sensor S2 after the passage of time $t_B$ (measured by the second timer) from when the first sheet activates the sensor S2. Therefore, the sensors on the downstream side, will be turned on by the second sheet after the passage of time $t_B$ from when the first sheet is detected. Consequently, if the second sheet was not detected after $t_B$, it is judged that the sheet has jammed in-between (FIG. 8B). In the high-speed mode, the second sheet will be delivered so as to activate the sensor S2 after the passage of time $t_A$ (measured by the first timer) from when the first sheet activates the sensor S2. Therefore, the sensors on the downstream side, will be turned on by the second sheet after the passage of time $t_A$ from when the first sheet is detected. Consequently, if the second sheet was not detected after $t_A$, it is judged that the sheet has jammed in between (FIG. 8C). These relations between the first and second sheets can be used for the following control, as the relations between the currently detected sheet and the next detected sheet.

Next, description will be made of the method of varying the conveying timing by monitoring the amount of chattering (time) of the contact-type sensor.

Figure 9:
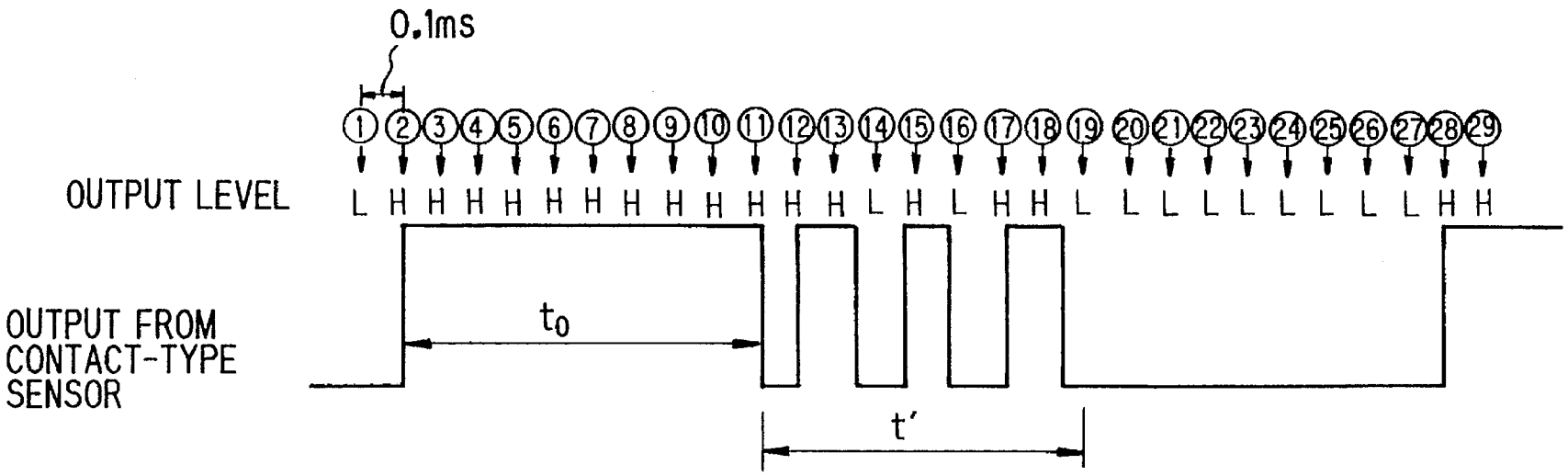
FIG. 9 is a timing chart showing chattering of a contact-type sensor.
Figure 10:
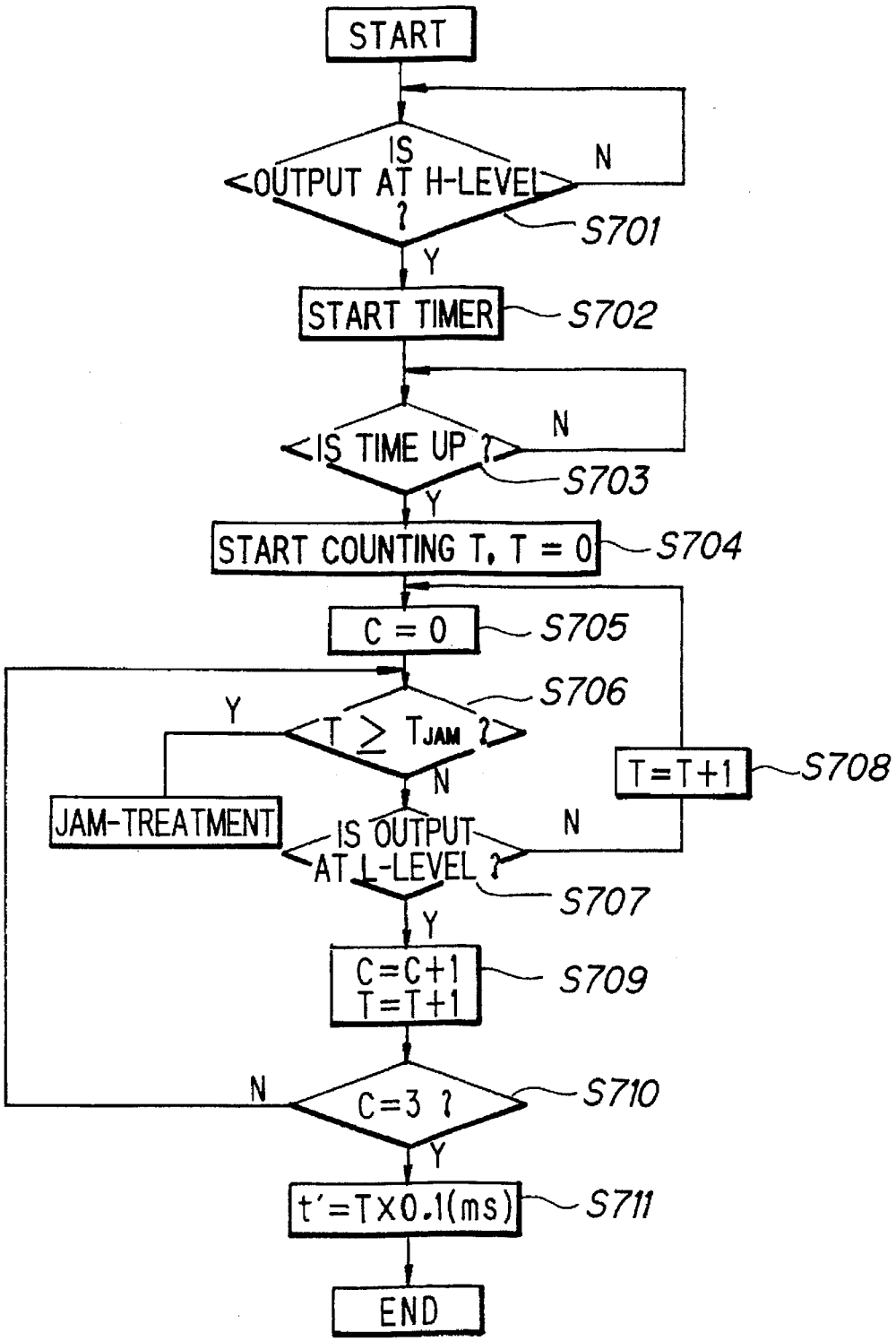
FIG. 10 is a flowchart showing the operation of measuring the time of chattering.

The amount of chattering, which is represented by time, will be monitored as follows (FIGS. 9 and 10):

For each of the sensors, the following operation is made. First, the output from the sensor is detected per 0.1 ms (at points of ↓ in FIG. 9). Here, L designates the output state when the sensor detects no sheet. If three times of L in a row was detected, it is judged that the chattering is completed. In accordance with the flow in FIG. 10, when a sheet comes, the output becomes H (S701). At this timing, the timer is started. (the size of the sheet has been known from the cassette previously selected so that the duration of the sensor being on can be known for each sheet. This duration will be represented by $t_0$) (S702). The system stands by until the timer counts up to $t_0$ (S703). As soon as the timer reaches $t_0$, a counter T is activated in order to check the chattering, that is, the repeated on-and-off states after $t_0$ (S704). The settlement of chattering is determined when three times of the 'L'-output in a row have been detected. A counter C counts the number of times of the 'L'-output (S705). If the value of T is extremely large (specifically, when the output has held at 'H'-state for a prolonged period of time), there is a possibility of sheet jamming. Therefore, the maximum of T is previously determined as $T_{JAM}$ so that if T-value is greater than $T_{JAM}$, it can be assumed that the sheet has jammed (S706). As the flow set up from S705 to S710 is executed, it is determined that chattering is completed as soon as 'L'-output has been detected three times in a row after $t_0$. Then the operations goes to S711 where the time of chattering t' is determined.

Next, description will be made of the method of setting up the interval of sheet feeding. For all the sensors, the time of chattering is determined in the above manner in accordance with the flow in FIG. 11 (S801 to S812). When the checking operations have been completed up to the sensor S7, the maximum time of chattering is extracted from the sensors S2 through S7 (S813). The interval of sheet feeding is set up by, for example, taking the twice of the maximum chattering time so that this setup will be used for the next copying operation.

If the variation of the chattering time with the passage of time (or year) or with the number of copies is known, the interval of sheet feeding may be adjusted in accordance with the passage of year or the number of copies.

Figure 12:
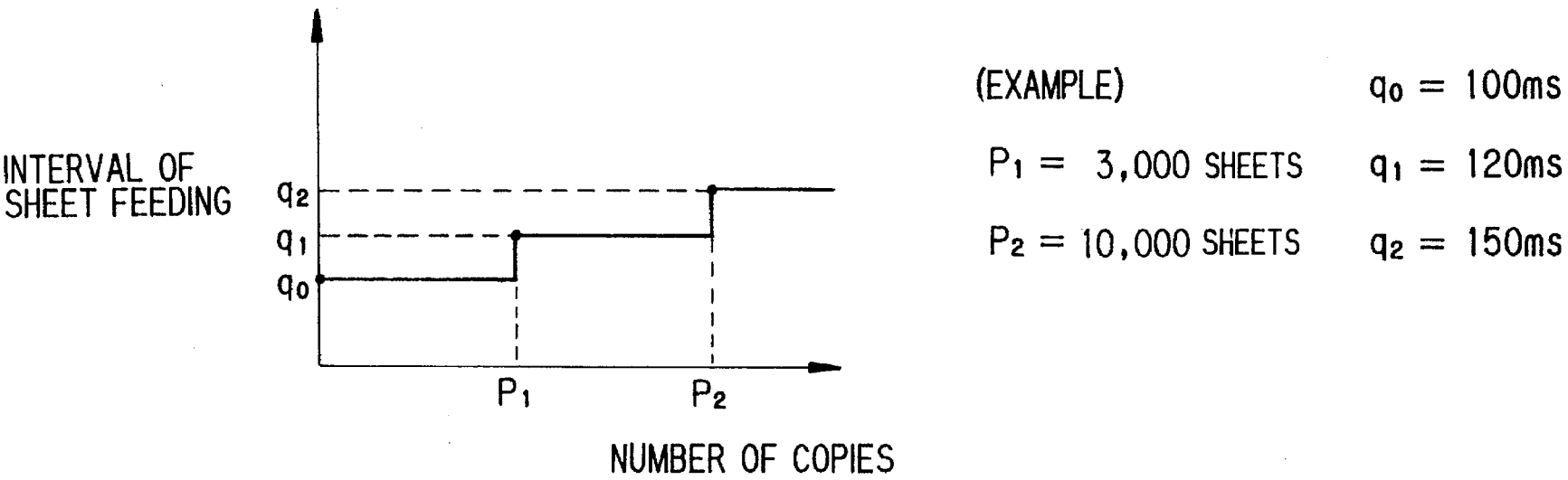
FIG. 12 is a graph showing a relation between the interval of sheet feeding and the time of copying.
Figure 13:
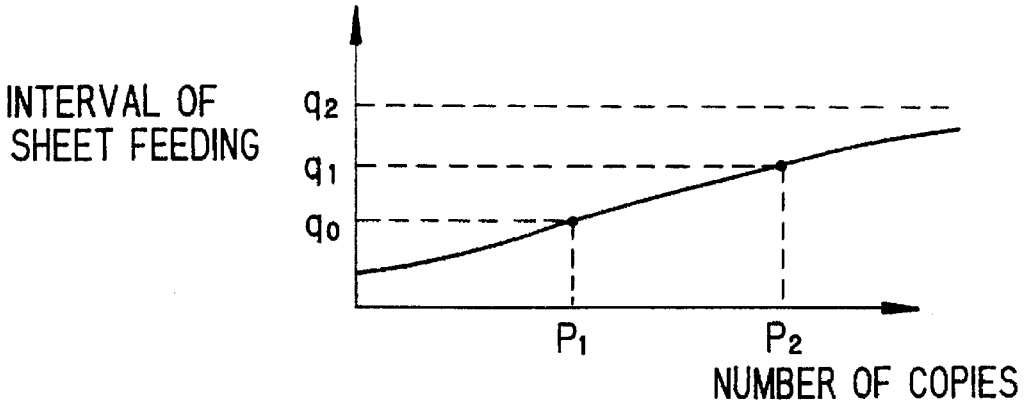
FIG. 13 is a graph showing a relation between the interval of sheet feeding and the time of copying.

For example, suppose that (when the relation between the number of copies and the required interval of sheet feeding is known as shown in FIG. 13), the time of sheet feeding is previously set up in accordance with the number of copies as shown in FIG. 12. In this case, if the number of copies has reached $P_1$, the interval of sheet feeding is set at $q_1$, and if the number of copies has reached P2, the interval of sheet feeding is set at $q_2$ (the interval was to be set at $q_0$ at the time of shipment from the factory).

Figure 2A:
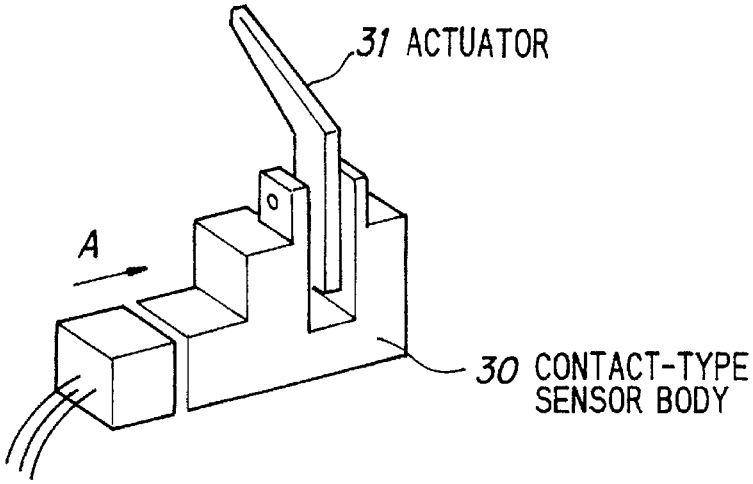
FIG. 2A PRIOR ART
FIG. 2A is a perspective view showing a contact-type sensor.
Figure 2B:
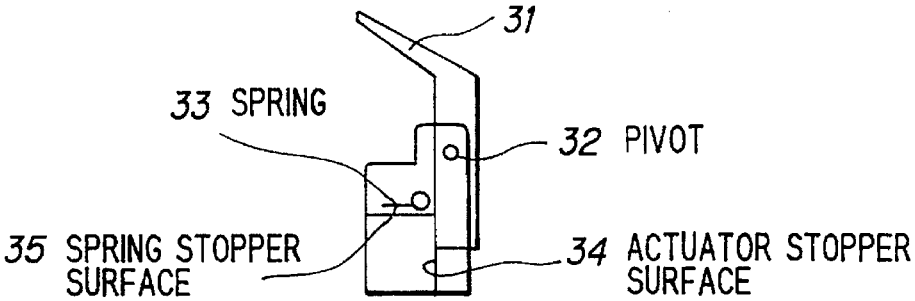
FIG. 2B PRIOR ART
FIG. 2B is a side view of FIG. 2A from the direction A.
Figure 3:
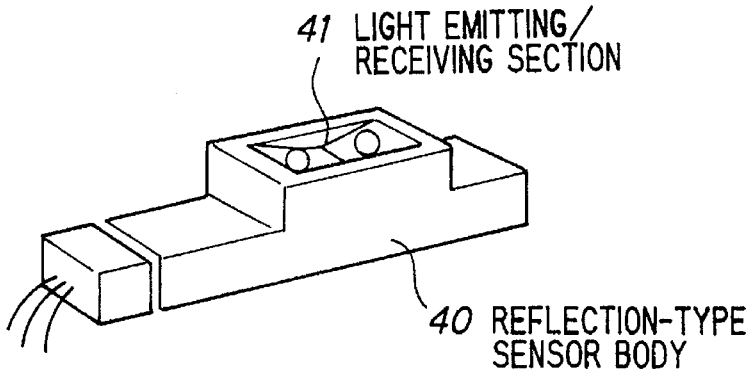
FIG. 3 PRIOR ART
FIG. 3 is a perspective view showing a reflection-type sensor.
Figure 4A:
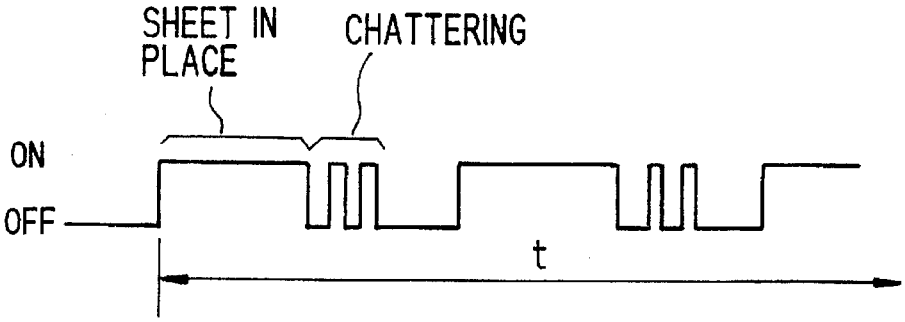
FIG. 4A PRIOR ART
FIG. 4A is a timing chart showing chattering of a contact-type sensor at long interval feeding.
Figure 4B:
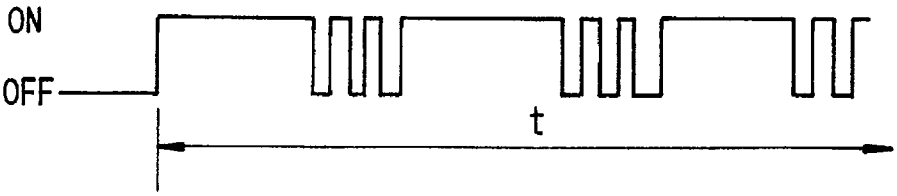
FIG. 4B PRIOR ART
FIG. 4B is a timing chart showing chattering of a contact-type sensor at short interval feeding.

Here, the variation in the amount of chattering with the passage of time is caused by the factors such as setting of the spring in fatigue, wear-out of the supporting portion in FIG. 2B.

Figure 14:
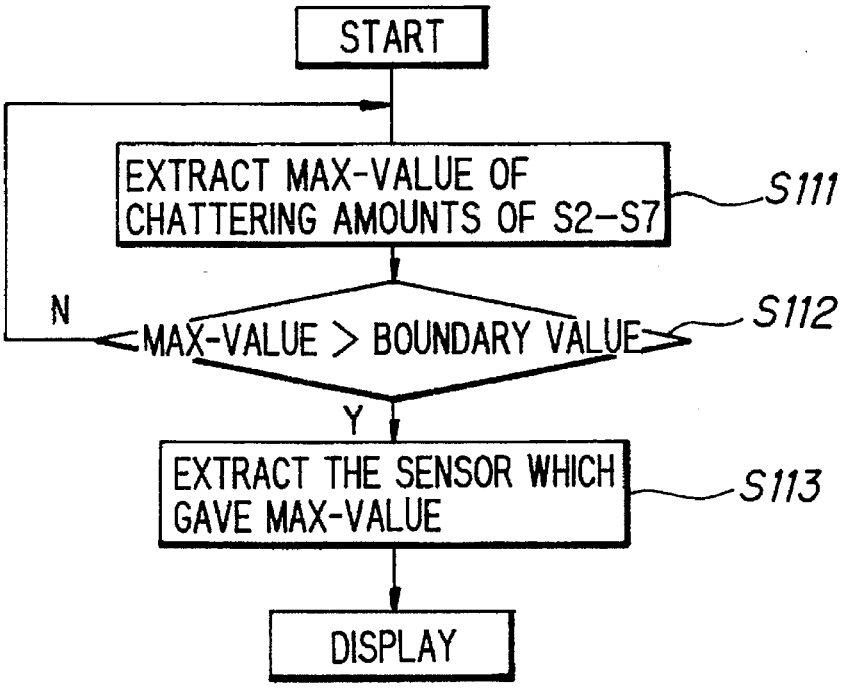
FIG. 14 is a flowchart showing the operation of locating the sensor which has a maximum time of chattering.

The variations in the amount of chattering with the passage of time will differ from the sensors one another in the individual copier. It is unreasonable to increase the interval of sheet feeding as a whole if one of the sensors increases in its time of chattering. In this case, only the sensor should be replaced. For this purpose, a method is necessary to locate the sensor which is to be replaced. This method will be explained in accordance with the flowchart shown in FIG. 14.

Figure 11:
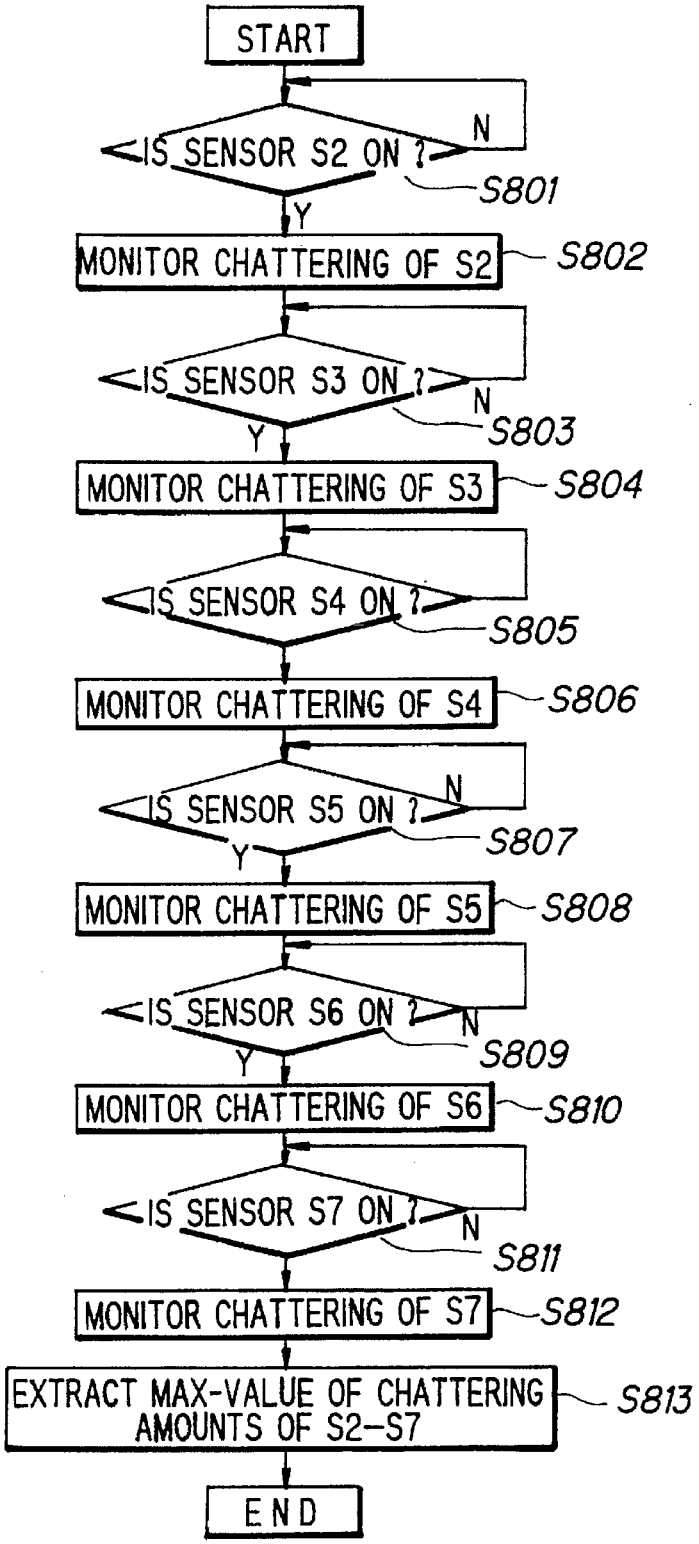
FIG. 11 is a flowchart showing the operation of measuring the time of chattering using different sensors.

Initially, the amount of chattering is monitored for each of the sensors S2 to S7, and the maximum (MAX) of these monitored values is extracted in the manner shown in the flowchart of FIG. 11 (at this point, the amount of chattering for each sensor is known) (S111). A boundary value of the amount of chattering should be previously determined. This boundary value is set so that if any of the sensors presents chattering in the amount in excess of this value, the performances of the copier will not operate properly (For example, the copy speed will not meet the value specified.).

If the extracted maximum amount of chattering (MAX) is greater than the boundary value (S112), the sensor which exhibits the MAX-value is displayed on an unillustrated display device to warn the user since the sensor has been already known (S113).

On the other hand, to deal with the case where if the user wanted to continue the operation by permitting that the copy speed would not meet the specifications, it is possible to set up the copier so that the operation can be continued of the user's will by setting up the interval of sheet feeding in accordance with the aforementioned method.

As has been described hereinabove, in accordance with the first feature of the invention, sheets of plain paper can be fed at a high rate and OHP sheets can also be used although the feeding speed is inferior to that of plain paper sheets. As a result, it is possible to perform an efficient operation of sheet conveyance.

In accordance with the second feature of the invention, since the time of chattering is monitored, it is possible to set up the interval of sheet feeding optimally (at such a maximum speed that the operation is free from the influence of the chattering) for individual copiers.

In accordance with the third feature of the invention, if the variation of the chattering time with the passage of years or with the number of copies is known, it is possible to set up the timing of feeding sheets optimally without performing any complicated control, so that the operation may not be affected by the chattering.

In accordance with the fourth feature of the invention, if the time of chattering exceeds the boundary value, it is possible to easily modify the defect by replacing the sensor with trouble. Accordingly, it is possible to maintain the proper performances of the copier.

What is claimed is:

1. An image forming apparatus comprising:

a plurality of sensors disposed along the sheet conveyance path from the sheet feeding portion to the transfer portion, each of said sensors being composed of a contact-type sensor and a reflection-type sensor;

sheet-type determining means which, based on the detected output from the closest sensor to the sheet feeding portion, determines whether the fed sheet is of plain paper or of OHP film;

a first timer which sets up the predetermined arrival timing of the sheet to be conveyed through said sensors in accordance with the size of the sheet for the high-speed mode in which the sheets are fed at shorter intervals;

a second timer which sets up the predetermined arrival timing of the sheet to be conveyed through said sensors in accordance with the size of the sheet for the low-speed mode in which the interval of sheet feeding is controlled as long as possible within a predetermined range;

selecting means which selects said first timer when the type of the sheet determined by said sheet-type determining means is plain paper and selects said second timer in the case of OHP film; and warning means which, if in either of said modes, the sheet does not reach a predetermined site within the predetermined arrival time, determines that the sheet has jammed and informs the user of the point of jamming.

2. An image forming apparatus according to claim 1 further comprising:

conveyance timing-adjusting means which when the sheet is not detected by the reflection-type sensors, monitors the output signals from all the contact-type sensors and adjusts the conveyance timing of the sheet in the low-speed conveying mode in accordance with the augment of the amount of chattering detected from the output signals.

3. An image forming apparatus according to claim 1 further comprising:

conveyance timing-adjusting means which adjusts the conveyance timing of the sheet in the low-speed conveying mode in accordance with the predetermined number of copies and predetermined passage of time.

4. An image forming apparatus according to claim 1 further comprising:

warning means which when the sheet is not detected by the reflection-type sensors, monitors the output signals from all the contact-type sensors and informs the location of the only sensor which presents an excessive amount of chattering over a predetermined boundary value.

* * * * *